US005326257A

United States Patent [19]

Taylor et al.

[11] Patent Number: 5,326,257

[45] Date of Patent: Jul. 5, 1994

[54] GAS-FIRED RADIANT BURNER

[75] Inventors: Curtis L. Taylor, Muncie; Paul A. Pellinen, Yorktown, both of Ind.

[73] Assignee: Maxon Corporation, Muncie, Ind.

[21] Appl. No.: 964,651

[22] Filed: Oct. 21, 1992

[51] Int. Cl.[5] ..... F23D 14/14

[52] U.S. Cl. ..... 431/329

[58] Field of Search ..... 431/328, 329

[56] References Cited

U.S. PATENT DOCUMENTS

| | | | |
|---|---|---|---|
| 3,258,058 | 6/1966 | Lherault et al. | 431/329 |
| 3,529,916 | 9/1970 | Krieger | 431/329 |
| 3,847,536 | 11/1974 | Lepage | 431/329 |
| 3,857,669 | 12/1974 | Smith et al. | 431/328 |
| 3,857,670 | 12/1974 | Karlovetz et al. | 431/329 |
| 5,101,558 | 4/1992 | Grob et al. . | |

FOREIGN PATENT DOCUMENTS

| | | |
|---|---|---|
| 464692 | 10/1925 | Fed. Rep. of Germany . |
| 153017 | 8/1984 | Japan . |

OTHER PUBLICATIONS

"Tech Profile: Advanced Industriál Infrared Burner", Gas Research Institute Report, Chicago, Illinois, 0891RPP12000 (2 pages).

"Science Newsfront", Popular Science, Jun. 1991 (p. 26).

"Experimental Study of Ultra-Low Emission Radiant Porous Burner", Tian-yu Xiong, Institute of Gas Technology, Chicago, Illinois (pp. 1-3).

"SICONEX TM Fiber-Reinforced Ceramic Data Sheet", 3M, St. Paul, Minnesota, 1991 (one page).

Krieger Infra-Air® Advertising Literature, pp. 1-4, date unknown.

*Primary Examiner*—Carroll B. Dority

*Attorney, Agent, or Firm*—Barnes & Thornburg

[57] ABSTRACT

A radiant burner includes a housing for receiving a combustible air and fuel mixture and a combustor unit formed to include an open-space combustion chamber having a top opening and passageways for communicating the combustible air and fuel mixture from the housing to the open-space combustion chamber. The combustor unit is a block of insulation material formed to include a cavity defining the open-space combustion chamber and a plurality of apertures defining the passageways. The combustible air and fuel mixture extant in the open-space combustion chamber is ignited to produce a flame. The top opening of the open-space combustion chamber is covered to define a flame retention region therein so that the flame is stabilized in and contained wholly within the open-space combustion chamber. The cover is provided by a radiant member having a heat-receiving surface communicating with the underlying flame produced in the open-space combustion chamber and blocking passage of the flame through the radiant member and a heat-radiating surface emitting flameless thermal radiation to heat a product positioned above the radiant member.

51 Claims, 2 Drawing Sheets

GAS-FIRED RADIANT BURNER

BACKGROUND AND SUMMARY OF THE INVENTION

The present invention relates to burner assemblies, and particularly to gas-fired radiant burners. More particularly, the present invention relates to a radiant burner having a fast-heating and quick-cooling radiant surface for using a flame produced in the radiant burner efficiently to heat material passing over the radiant surface.

Radiant burners are typically used to dry, singe, or cure sheet material such as papers or textiles as it rolls past the burner on a line in a mill. It is also well known to dry paints, cure meats and synthetic resins, heat-treat various metals, and perform other types of industrial drying and heating operations using radiant burners.

Typically, a radiant burner includes a ceramic element or other refractory material that is heated by a flame fueled by a combustible mixture of air and gas to cause the ceramic element to emit radiant heat. It will be understood that radiant heat is heat transmitted by radiation as opposed to convection or conduction. In many applications, a radiant burner is preferred over an open-flame industrial burner because it can be operated to produce an intense heat that can be transmitted at a uniform rate over a wide area to a product moving past the radiant burner.

Conventional radiant burners are often slow to cool which can lead to significant product damage or even loss during a line shutdown. For example, if the paper in a line would stop rolling, the heat from a conventional radiant burner provided to dry the paper could ignite the paper causing a fire unless the radiant burner is able to cool quickly enough once turned off during a line stoppage or shutdown. Accordingly, there is a need in industry for a quick-cooling radiant burner.

There is always a need for a radiant burner that is able to maximize heat output while minimizing unwanted emissions of nitrogen oxides and carbon monoxide. Many proposed and enacted state and federal environmental regulations require that air-polluting emissions from industrial burners be reduced. During the development of an improved radiant burner in accordance with the present invention, it has been observed that it is possible to reduce the formation of thermally generated nitrogen oxide emissions by reducing the burner's flame temperature and carbon monoxide emissions by increasing the temperature of the burner's heat-radiating surface. A radiant burner designed to use fuel more efficiently to generate higher heat output at the heat-radiating surface using a lower flame temperature would lead to lower carbon monoxide and nitrogen oxide emissions and thus be a welcomed improvement over conventional radiant burners.

In the industry, it is not uncommon for hot radiant burners to be splashed with water during use. One problem known to users of industrial burners is that it often takes a long time for the heat-radiating surfaces of a conventional radiant burner to recover its surface temperature once it has been quenched with a liquid such as water. This temporary loss of surface temperature can lead to uneven product drying or curing, and thereby reduce product quality. A refractory-type radiant surface can be destroyed and fractured by splashed water. It would therefore be desirable to provide an improved radiant burner that heats quickly once quenched to minimize disruption to the surface temperature of its heat-radiating surface, and thereby exhibits good quench recovery.

According to the present invention, a radiant burner includes a plenum for receiving a combustible air and fuel mixture, a combustor unit, an ignition means, and a radiant member over the combustor unit. The combustor unit is formed to include an open-space combustion chamber having a top opening. The radiant member covers the top opening of the open-space combustion chamber to define an open flame-retention region in the open-space combustion chamber.

The combustor unit is also formed to include means for communicating the combustible air and fuel mixture from the plenum to the open-space combustion chamber. The ignition means ignites the combustible air and fuel mixture extant in the open-space combustion chamber to produce a flame underneath the radiant member. The radiant member includes a heat-receiving surface communicating with the underlying flame produced in the open-space combustion chamber and a heat-radiating surface emitting thermal radiation to heat a product positioned above the radiant member. By covering the top opening of the open-space combustion chamber, the radiant member operates to stabilize the flame the open flame-retention region provided in the open-space combustion chamber.

In preferred embodiments, the combustor unit is a unified block of ceramic fiber insulation material that is vacuum-formed in a mold to include a top-opening cavity defining the open-space combustion chamber and a plurality of apertures or conduits extending through the bottom of the block and coupling the plenum to the open-space combustion chamber to define the communicating means. The ceramic fiber insulation material has a low thermal conductivity and is formed to surround and underlie the flame produced in the open-space combustion chamber. Advantageously, the side walls of the block help to direct heat produced by the flame upwardly toward the heat-receiving surface of the radiant member. This maximizes radiant, convective, and conductive heat transfer from the flame to the radiant member. Also, the bottom wall containing the fuel-conducting apertures helps keep the temperature of the combustible air and fuel mixture in the underlying plenum below its ignition point.

Also in preferred embodiments, the radiant member is a flat, thin, woven, rigid sheet of porous ceramic material. Illustratively, the radiant member is a web of ceramic fibers coated with silicon carbide to enhance the thermal radiation emissivity of the radiant member. The radiant member is positioned over the top-opening of the open-space combustion chamber and is lightweight to heat up and cool down quickly.

This thin radiant member is characterized in use by a uniform surface temperature and radiant heat flux profile. It will be understood that radiant heat flux is the rate of emission or transmission of radiant energy. Because of these characteristics, the radiant member is able to remove a lot of heat from the combustion reaction taking place in the open-space combustion chamber and transmit that heat to the product to be heated. With the removal of this heat, the flame temperature is reduced and the formation of thermally generated nitrogen oxide emissions are reduced. Carbon monoxide emissions are low because the high surface temperature of the improved radiant member successfully burns any remaining species of carbon monoxide from the fuel lean combustion process. Also, in part because of its low mass, the improved radiant member is able to recover its surface temperature quickly after being splashed with water and thereby exhibits good quench recovery.

Because of the positioning of the radiant member over the flame in the open-space combustion chamber, the heat-receiving surface of the radiant member is heated by radiation, convection, and conduction. In turn, the heat-radiating surface emits thermal radiation to heat a product positioned above the radiant member. Advantageously, the porous character of the radiant member permits some heat flow therethrough to cause a product above the radiant member to be heated also by convection.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
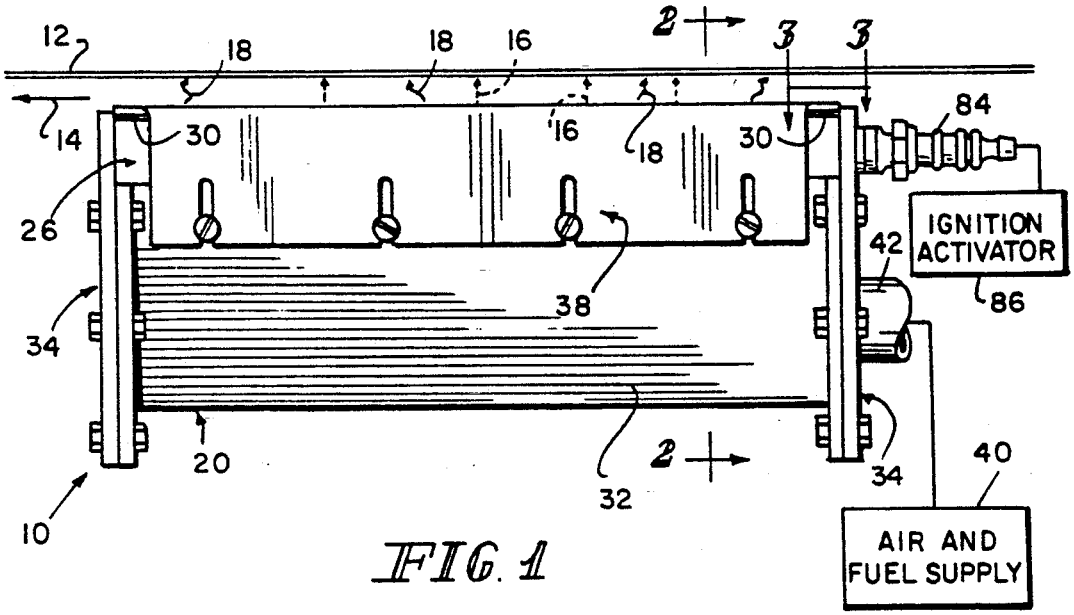
FIG. 1 is a side elevation view of a radiant burner assembly in accordance with the present invention showing a sheet of material being heated as it passes over a radiant member included in the radiant burner assembly.

As shown in FIG. 1, a gas-fired radiant burner assembly 10 is used in industrial processes to heat a sheet of material 12 moving in direction 14 over the top of burner 10. Advantageously, burner 10 is configured so that moving sheet of material 12 is heated by radiation 16 and convection 18 as shown diagrammatically in FIGS. 1 and 2. It will be understood that burner 10 is well-suited for use in heating a variety of products, including, for example, papers, textiles, plastics materials, painted objects, foods, glasses, and metals to dry, cure, heat and/or form those products. In many applications, several burners 10 will be joined together end-to-end to form a longer line of radiant burner surfaces to heat wide materials or products.

Figure 2:
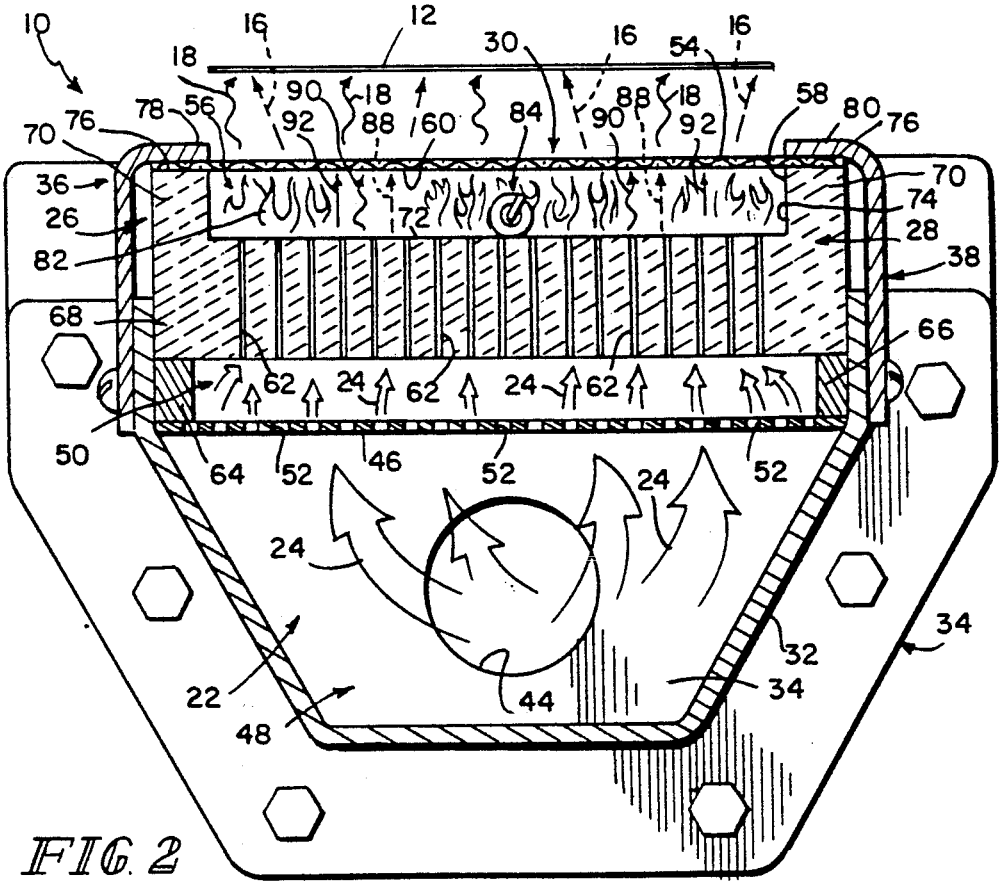
FIG. 2 is an enlarged sectional view taken along line 2—2 of FIG. 1 showing a hollow housing containing a plenum for receiving a combustible mixture of air and fuel, a perforated distribution plate in the plenum, a unified block of insulation material above the plenum and containing an open-space combustion chamber and a row of vertical air and fuel supply conduits, and a radiant member covering a top opening of the open-space combustion chamber.

As shown in FIGS. 1 and 2, the burner 10 includes a hollow housing 20 containing a lower interior region 22 for receiving a combustible air and fuel mixture 24 and an upper interior region 26 housing a combustor unit 28 and a radiant member 30. The housing 20 includes a pan-shaped lower shell 32, a pair of end panel assemblies 34 attached to opposite ends of lower shell 32, and spaced-apart, elongated first and second upper shell halves 36, 38. Air and fuel supply 40 is provided to deliver a combustible premixed supply of air and fuel into the lower interior region 22 via a conduit 42 as shown diagrammatically in FIG. 1 and an outlet opening 44 formed in one of the end panel assemblies 34 as shown in FIG. 2.

A perforated distribution plate 46 is mounted in the lower shell 32 above the outlet opening 44 as shown in FIG. 2 to partition the lower interior region 22 into a lower plenum 48 receiving the air and fuel mixture 24 from the supply means 40, 42 and an upper plenum 50 communicating with the underside of the combustor unit 28. The distribution plate 46 is a thin gauge steel plate that is perforated to include an array of apertures 52 for communicating the combustible air and fuel mixture 24 from the lower plenum 48 into the upper plenum 50. The plate 46 operates to distribute the combustible air and fuel mixture uniformly throughout the upper plenum 50. Advantageously, temperature variations on the exterior heat-radiating surface 54 of the radiant member 30 are minimized because of the generally uniform distribution of the combustible air and fuel mixture 24 in the upper plenum 50.

The combustor unit 28 is formed to include an open-space combustion chamber 56 having a top opening 58 facing toward a heat-receiving surface 60 on the underside of the radiant member 30. The combustor unit 28 is also formed to include a plurality of apertures 62 that function as conduits to communicate the pressurized combustible air and fuel mixture 24 in upper plenum 50 into the open-space combustion chamber 56. As shown in FIG. 2, the combustor unit 28 rests on top of a pair of spaced-apart side support rails 64, 66 arranged to lie inside the upper edge of lower shell 32 and on the upper surface of the perforated distribution plate 46.

Illustratively, the combustor unit 28 is a unified block of insulation material. For example, a high temperature ceramic fiber insulation material such as FIBERFRAX® DURABOARD™ 2600 or 3000 available from Standard Oil Engineered Materials Company of Niagara Falls, N.Y. is presently thought to be a suitable material. Preferably, the unified block 28 is formed in one piece by vacuum-forming the insulation material in a mold (not shown) to produce a top cavity defining the open-space combustion chamber 56 and a plurality of rows and columns of apertures defining the air and fuel supply conduits 62.

Figure 3:
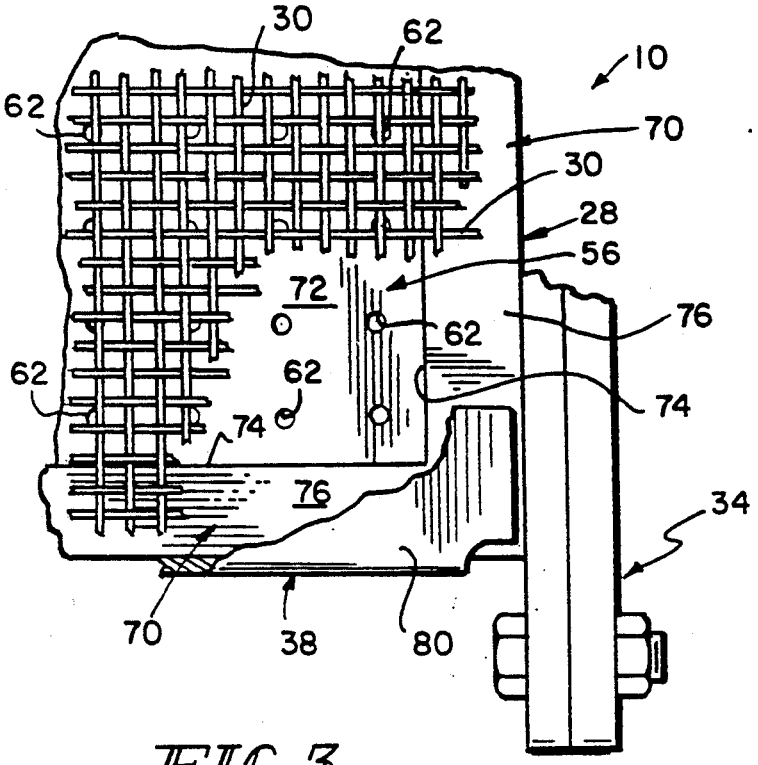
FIG. 3 is an enlarged view taken along line 3—3 of FIG. 1 of one corner of the radiant burner assembly, with portions broken away to show the radiant member and the grid of air and fuel supply conduit outlet ports formed in the floor of the underlying open-space combustion chamber.

As shown in FIGS. 2 and 3, the unified block 28 is formed to include a relatively thick bottom section 68 and a rectangular side section 70 lying around a perimeter edge of the bottom section 68 and cooperating with the bottom section 68 to define the open-space combustion chamber 56. Preferably, the unified block 28 is made of an insulation material having a thermal conductivity below 1.5 BTU.in/hr.ft$^2$°F. The boundaries of the open-space combustion chamber 56 are defined by a floor 72 on bottom section 68, four side walls 74 on side section 70, and a central rectangular portion of the heat-receiving surface 60 on radiant member 30. These surfaces and walls cooperate to define an open flame retention region in the open-space combustion chamber 56 as shown best in FIG. 2.

Figure 4:
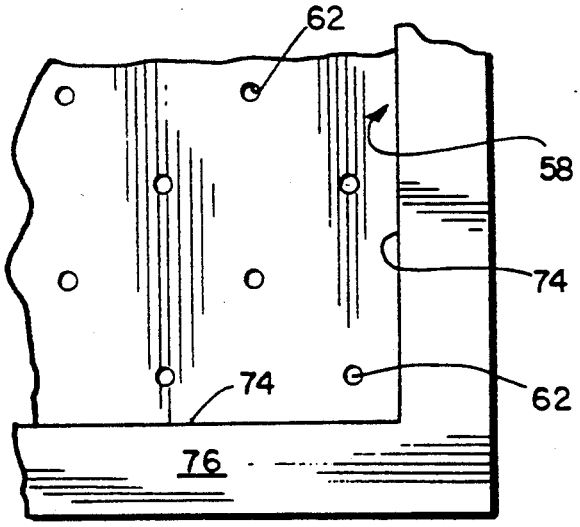
FIG. 4 is a view similar to FIG. 3 showing an alternative or staggered arrangement of air and fuel supply outlet ports.

The air and fuel supply conduits 62 formed in unified block 28 are preferably arranged to lie in rows and columns and in uniformly spaced-apart alignment as shown in FIGS. 2 and 3. Each conduit 62 includes an inlet port opening in the upper plenum 50 and an outlet port opening in the floor 72 of the open-space combustion chamber 50. As shown best in FIG. 3, the outlet ports of the conduits 62 are arranged in a grid-like pattern to lie in uniformly spaced-apart relation to adjacent ports in the same row or column. Also, the outlet ports around the perimeter of the array of outlet ports lie in uniformly spaced-apart relation to the adjacent side walls 74 as shown best in FIG. 3. This uniform arrangement of outlet ports helps to deliver a uniform flow of combustible air and fuel mixture into the open-space combustion chamber 56 to produce a uniform temperature profile across the length and width (e.g., area) of the open-space combustion chamber 56. In other embodiments, the outlet ports may be arranged in a staggered pattern as shown in FIG. 4 rather than in rows as shown in FIG. 3. Once the combustible mixture 24 is ignited, a little visible flame tip (not shown) will generally appear at each of the outlet ports.

Advantageously, the insulated side sections 70 of unified block 28 cooperate to surround the flame 82 produced in the open-space combustion chamber 56 and direct heat generated therein toward the heat-receiving surface 60 of the radiant member 30 to maximize the efficiency of burner 10. In effect, the unified block 28 is configured to help retain the flame 82 in the open-space combustion chamber 56 and minimize natural cooling losses that might otherwise occur due to conduction, convection, and radiation. Also, the insulated bottom section 68 of unified block 28 functions as a heat shield to keep the temperature of the combustible air and fuel mixture 24 extant in upper plenum 50 below its ignition point. These features contribute to the overall efficiency of the improved radiant burner 10 by minimizing cooling losses and providing more heat to the radiant member 30. By providing efficient flame management, the radiant burner 10 is able to harness the energy of the flame 82 in the open-space combustion chamber 56 to create a higher surface temperature on the heat-radiating surface 54 of the radiant member.

Radiant member 30 is a thin, low-mass sheet positioned to cover the top opening 58 of the open-space combustion chamber 56 as shown in FIG. 3. The radiant member 30 is supported on top of the unified block of insulation material 28 to lie above the flame 82. In practice, the "weave density" or "mesh" of radiant member 30 is tighter than what is shown in FIG. 3. Using artistic liberty, a looser weave density was adopted in preparing the view illustrated in FIG. 3 to show the grid-like arrangement of the array of air and fuel supply conduit outlet ports 62 in the floor 72 of the open-space combustion chamber 56 more clearly. Preferably, radiant member 30 is made of a fiber-reinforced ceramic such as SICONEX TM available from 3M of St. Paul, Minn. Such a material is a composite consisting of ceramic fibers in a matrix of silicon carbide. This material has a density of about 140 $lb/ft^3$ (2.7 $g/cm^3$).

In a presently preferred embodiment, a sheet of SICONEX TM Fiber-Reinforced Ceramic having a thickness of 0.0625 inch (0.16 cm) and a porosity of less than twelve percent open area was used to provide a radiant member 30 in radiant burner 10. In testing, this lightweight (low mass) radiant member 30 was able to heat up to achieve a 2100° F. (1149° C.) surface temperature on heat-radiating surface 54 in less than ten seconds and cool down to achieve a surface temperature on heat-radiating surface 54 below 400° F. (204° C.) in less than ten seconds.

Because the low mass radiant member 30 is thin and flat and includes a highly emissive surface material such as silicon carbide, it is able to provide a higher and more uniform radiant heat flux than conventional radiant burners. Because it provides a high radiant heat flux, radiant member 30 operates to remove a lot of heat from the open-space combustion chamber 56, thereby lowering the temperature of flame 82 and reducing the formation of thermally generated nitrogen oxide emissions. Also, the high surface temperature of the radiant member 30 operates to reduce carbon monoxide emissions by burning any remaining species of carbon monoxide from the fuel lean combustion process. Quenching recovery is also good as the radiant member 30 is able to recover its surface after being splashed with water in about ten seconds or less due to its low mass.

As shown in FIGS. 2 and 3, the radiant member 30 is placed on top of the combustor unit 28 so that the perimeter of the heat-receiving surface 60 of radiant member 30 abuts the endless top edge border 76 of the rectangular side section 70. The first and second upper shell halves 36, 38 each include clamp portions 78, 80 for engaging the heat-radiating surface 54 and holding the radiant member 30 tightly against the top edge border 76 of combustor unit 28. The radiant member 30 is positioned over the open-spaced combustion chamber 56 so that the flame 82 produced by using an ignition device 84 and an ignition activator 86 to ignite the combustible air and fuel mixture 24 extant in the open-space combustion chamber 56 contacts the heat-receiving surface 60 of the radiant member 30. As such, combustion in radiant burner 10 takes place under the heat-radiating surface 54. By using radiation 88, convection 90, and conduction 92 to heat the heat-receiving surface 60 as shown diagrammatically in FIG. 2, it is possible to sustain high surface temperatures of about 2100° F. (1149° C.) to 2200° F. (1204° C.), and in some cases, 2350° F. (1288° C). High surface temperature is an important factor in evaluating radiant burner efficiency because the ability of a radiant burner to dry certain materials is controlled by its emitted wave length which is a function of surface temperature.

In contrast, conventional radiant burners (not shown) operate much differently from radiant burner 10. Some burners rely on surface combustion wherein a flame is stabilized above the heat-radiating surface. A large amount of radiant energy is lost using this method since the flame is above the heat-radiating surface and must reflect its energy back down toward the underlying heat-radiating surface. In other conventional radiant burners, a flame is projected across a surface so that such surface is caused to radiate heat. Also, some conventional radiant burners are designed to produce a flame inside a layer of ceramic foam. As noted previously, an advantage of radiant burner 10 over the foregoing radiant burners is that a flame 82 is retained in an open-space combustion chamber 56, the open-space combustion chamber 56 is insulated to minimize heat loss, and the heat-receiving surface 60 is positioned to be heated by conduction, convection, and radiation, thereby causing the heat-radiating surface 60 to be heated to a higher surface temperature and lowering carbon monoxide emissions. By using an insulated layer around the open-space combustion chamber 56 and configuring radiant member 30 to discharge more heat from the open-space combustion chamber 56 to the atmosphere by radiation and convection, it is possible to operate radiant burner 10 at a lower flame temperature, thereby reducing the formation of thermally generated nitrogen oxide emissions.

Although the invention has been described in detail with reference to certain preferred embodiments, variations and modifications exist within the scope and spirit of the invention as described and defined in the following claims.

We claim:

1. A radiant burner comprising means for receiving a combustible air and fuel mixture, a combustor unit formed to include an open-space combustion chamber having a top opening and means for communicating the combustible air and fuel mixture from the receiving means to the open-space combustion chamber, the combustor unit being a block of insulation material formed to include a cavity defining the open-space combustion chamber and a plurality of apertures defining the communicating means, means for igniting the combustible air and fuel mixture extant in the open-space combustion chamber to produce a flame, and means for covering the top opening of the open-space combustion chamber to define a flame retention region therein so that the flame is stabilized in and contained wholly within the open-space combustion chamber, the covering means including a radiant member having a heat-receiving surface communicating with the underlying flame produced in the open-space combustion chamber and blocking passage of the flame through the radiant member and a heat-radiating surface emitting flameless thermal radiation to heat a product positioned above the radiant member.

2. The radiant burner of claim 1, wherein the insulation material is made of ceramic fibers and has a thermal conductivity of less than 1.5 BTU.in/hr.ft$^2$°F.

3. The radiant burner of claim 1, wherein the block of insulation material including the cavity and the plurality of apertures is made by vacuum-forming a material including ceramic fibers in a mold.

4. The radiant burner of claim 1, wherein the combustor unit includes a bottom section and a side section lying around a perimeter edge of the bottom section and cooperating with the bottom section to define interior walls of the open-space combustion chamber underneath the radiant member and the communicating means includes a plurality of apertures formed in the bottom section and arranged to conduct the combustible air and fuel mixture from the receiving means through the bottom section into the open-space combustion chamber.

5. The radiant burner of claim 4, wherein the side section is made of ceramic fiber insulation material having a thermal conductivity below a predetermined level of 1.5 BTU.in/hr.ft$^2$°F. and is configured to provide means around the flame for directing heat generated by combustion in the open-space combustion chamber upwardly toward the heat-receiving surface of the radiant member.

6. The radiant burner of claim 4, wherein the bottom section lies above the receiving means, the bottom section is made of ceramic fiber insulation material having a thermal conductivity below a predetermined level of 1.5 BTU.in/hr.ft$^2$°F., and the bottom section is configured to provide means underneath the flame for keeping the temperature of the combustible air and fuel mixture in the underlying receiving means below an ignition point without disrupting flow of said mixture from the receiving means to the open-space combustion chamber through the plurality of apertures formed in the bottom section.

7. The radiant burner of claim 4, wherein the bottom section is formed to include an outlet port opening for each aperture, each outlet port opens into the open-space combustion chamber, and the outlet ports are arranged in intersecting rows and columns cooperating to define a grid pattern having a plurality of intersection points to position each outlet port at one of the intersection points o the grid pattern.

8. The radiant burner of claim 7, wherein the side section includes vertical side walls forming a closed interior side of the open-space combustion chamber, the bottom section includes a horizontal bottom wall defining a floor of the open-space combustion chamber and containing the outlet ports, and the outlet ports lying around an outer perimeter of the grid pattern are arranged to lie in uniformly spaced-apart relation to an adjacent one of the vertical side walls to define an array of outlet ports arranged in uniformly spaced-apart rows and columns.

9. A radiant burner comprising means for receiving a combustible air and fuel mixture, a combustor unit formed to include an open-space combustion chamber having a top opening and means for communicating the combustible air and fuel mixture from the receiving means to the open-space combustion chamber, means for igniting the combustible air and fuel mixture extant in the open-space combustion chamber to produce a flame, and means for covering the top opening of the open-space combustion chamber to define a flame retention region therein so that the flame is stabilized in the open-space combustion chamber, the covering means including a radiant member having a heat-receiving surface communicating with the underlying flame produced in the open-space combustion chamber and a heat-radiating surface emitting thermal radiation to heat a product positioned above the radiant member, the radiant member being a single layer web of ceramic fibers coated with silicon carbide.

10. A radiant burner comprising means for receiving a combustible air and fuel mixture, a combustor unit formed to include an open-space combustion chamber having a top opening and means for communicating the combustible air and fuel mixture from the receiving means to the open-space combustion chamber, means for igniting the combustible air and fuel mixture extant in the open-space combustion chamber to produce a flame, and means for covering the top opening of the open-space combustion chamber to define a flame retention region therein so that the flame is stabilized in the open-space combustion chamber, the covering means including a radiant member having a heat-receiving surface communicating with the underlying flame produced in the open-space combustion chamber and a heat-radiating surface emitting thermal radiation to heat a product positioned above the radiant member, the radiant member being a rigid sheet of ceramic material.

11. The radiant burner of claim 10, wherein the rigid sheet of ceramic material is flat and has a maximum thickness of 0.0625 inches (0.16 cm).

12. The radiant burner of claim 10, wherein the rigid sheet of ceramic material is porous and arranged to lie above the flame generated in the open-space combustion chamber and position the heat-receiving surface in contact with the flame generated in the open-space combustion chamber.

13. The radiant burner of claim 12, wherein the rigid sheet of ceramic material has a porosity of less than twelve percent open area.

14. The radiant burner of claim 10, wherein the radiant member further includes a silicon carbide coating on the rigid sheet of ceramic material to enhance the thermal radiation emissivity of the radiant member.

15. The radiant burner of claim 14, wherein the rigid sheet of ceramic material has a porosity of less than twelve percent open area.

16. A radiant burner comprising means for receiving a combustible air and fuel mixture, a combustor unit formed to include an open-space combustion chamber having a top opening and means for communicating the combustible air and fuel mixture from the receiving means to the open-space combustion chamber, the combustor unit being a block of insulation material formed to include a cavity defining the open-space combustion chamber and a plurality of apertures defining the communicating means, the combustor unit including a side section having an endless top edge border around an outer perimeter of the open-space combustion chamber, means for igniting the combustible air and fuel mixture extant in the open-space combustion chamber to produce a flame, and means for covering the top opening of the open-space combustion chamber to define a flame retention region therein so that the flame is stabilized in and contained wholly within the open-space combustion chamber, the covering means including a radiant member having a heat-receiving surface communicating with the underlying flame produced in the open-space combustion chamber and blocking passage of the flame through the radiant member and a heat-radiating surface emitting flameless thermal radiation to heat a product positioned above the radiant member, the covering means further including means for clamping the radiant member to the endless top edge border of the side section so that the radiant member covers the top opening of the open-space combustion chamber.

17. The radiant burner of claim 16, wherein the insulation material is made of ceramic fibers.

18. The radiant burner of claim 16, wherein the block of insulation material including the cavity and the plurality of apertures is made by vacuum-forming a material including ceramic fibers in a mold.

19. The radiant burner of claim 16, wherein the combustor unit includes a bottom section, the side section lies around a perimeter edge of the bottom section and cooperates with the bottom section to define the open-space combustion chamber underneath the radiant member, and the communicating means includes a plurality of apertures formed in the bottom section and arranged to conduct the combustible air and fuel mixture from the air and fuel mixture through the bottom section into the open-space combustion chamber.

20. The radiant burner of claim 19, wherein the receiving means includes a hollow housing coupled to the bottom section of the combustor unit.

21. The radiant burner of claim 20, wherein the receiving means further includes a perforated distribution plate mounted in the hollow housing and means for discharging the combustible air and fuel mixture into the hollow housing underneath the perforated distribution plate so that said mixture must pass through the perforated distribution plate before it reaches the apertures formed in the bottom section of the combustor unit.

22. The radiant burner of claim 19, wherein the bottom section includes an outlet port for each aperture, the outlet ports open into the open-space combustion chamber, and the outlet ports are arranged to lie in a plurality of uniformly spaced-apart rows.

23. The radiant burner of claim 22, wherein the outlet ports in each row are arranged in uniformly spaced-apart relation one to another.

24. The radiant burner of claim 16, wherein the side and bottom sections of the combustor unit are made of ceramic fiber insulation material.

25. A radiant burner comprising means for receiving a combustible air and fuel mixture, a combustor unit formed to include an open-space combustion chamber having a top opening and means for communicating the combustible air and fuel mixture from the receiving means to the open-space combustion chamber, the combustor unit being including a side section having an endless top edge border around an outer perimeter of the open-space combustion chamber, means for igniting the combustible air and fuel mixture extant in the open-space combustion chamber to produce a flame, and means for covering the top opening of the open-space combustion chamber to define a flame retention region therein so that the flame is stabilized in the open-space combustion chamber, the covering means including a radiant member having a heat-receiving surface communicating with the underlying flame produced in the open-space combustion chamber and a heat-radiating surface emitting thermal radiation to heat a product positioned above the radiant member, the covering means further including means for clamping the radiant member to the endless top edge border of the side section so that the radiant member covers the top opening of the open-space combustion chamber, the radiant member including a rigid flat sheet of ceramic material and a silicon carbide coating on the rigid flat sheet of ceramic material.

26. A radiant burner comprising means for receiving a combustible air and fuel mixture, a combustor unit formed to include an open-space combustion chamber having a top opening and means for communicating the combustible air and fuel mixture from the receiving means to the open-space combustion chamber, the combustor unit being including a side section having an endless top edge border around an outer perimeter of the open-space combustion chamber, means for igniting the combustible air and fuel mixture extant in the open-space combustion chamber to produce a flame, and means for covering the top opening of the open-space combustion chamber to define a flame retention region therein so that the flame is stabilized in the open-space combustion chamber, the covering means including a radiant member having a heat-receiving surface communicating with the underlying flame produced in the open-space combustion chamber and a heat-radiating surface emitting thermal radiation to heat a product positioned above the radiant member, the covering means further including means for clamping the radiant member to the endless top edge border of the side section so that the radiant member covers the top opening of the open-space combustion chamber, the radiant member having a maximum thickness of 0.0625 inch (0.16 cm) and a porosity of less than twelve percent open area.

27. A radiant burner comprising a radiant member including a sheet of porous ceramic material and a silicon carbide coating on the sheet of porous ceramic material, the sheet of porous ceramic material including a heat-receiving surface communicating with an underlying flame and a heat-radiating surface emitting thermal radiation and transferring thermal energy by convection to heat a product positioned above the heat-radiating surface, support means for defining an open-space combustion chamber underneath the heat-receiving surface so that a flame produced in the open-space combustion chamber is located adjacent to the radiant member to transfer heat to the heat-receiving surface by conduction, convection, and radiation, and means for producing a flame in the open-space combustion chamber to heat the heat-receiving surface of the radiant member.

28. The radiant burner of claim 27, wherein the sheet of porous ceramic material is a single layer web of ceramic fibers.

29. The radiant burner of claim 27, wherein the sheet of porous ceramic material has a thickness of less than 0.0625 inch (0.16 cm).

30. The radiant burner of claim 27, wherein the sheet of porous ceramic material has a density of 140 $lb/ft^3$ (2.7 $g/cm^3$).

31. The radiant burner of claim 30, wherein the sheet of porous ceramic material has a thickness of less than 0.0625 inch (0.16 cm).

32. The radiant burner of claim 27, wherein the sheet of porous ceramic material is formed to include a plurality of pores and a porosity of less than twelve percent open area.

33. The radiant burner of claim 27, wherein the support means includes a unified block of insulation material formed to include the open-space combustion chamber and border means for engaging the heat-receiving surface to support the radiant member so that the heat-receiving surface overlies the open-space combustion chamber and communicates with the flame produced therein.

34. The radiant burner of claim 33, wherein the unified block of insulation material is made of ceramic fibers and has a thermal conductivity of less than 1.5 $BTU.in/hr.ft^2{}^\circ F$.

35. The radiant burner of claim 33, wherein the unified block of insulation material includes ceramic fibers fused together by vacuum-forming.

36. The radiant burner of claim 33, wherein the support means further includes clamp means for engaging the heat-radiating surface to clamp the heat-receiving surface to the border means so that the radiant member is fixed to the unified block of insulation material to cover the open-space combustion chamber.

37. The radiant burner of claim 27, wherein the support means includes a bottom section forming an interior floor of the open-space combustion chamber and a rectangular side section appended to the bottom section and forming side walls of the open-space combustion chamber and the bottom and side sections are made of a ceramic fiber insulation material to provide means for directing heat generated by the flame in the open-space combustion chamber toward the overlying heat-receiving surface of the radiant member.

38. The radiant burner of claim 37, wherein the producing means includes means for receiving a combustible air and fuel mixture and aperture means in the bottom section for communicating the combustible air and fuel mixture from the receiving means into the open-space combustion chamber through the bottom section.

39. The radiant burner of claim 38, wherein the aperture means includes an array of apertures formed in the bottom section and arranged in a grid pattern.

40. The radiant burner of claim 38, wherein the receiving means includes a hollow housing coupled to the bottom section and formed to include an interior region, means for partitioning the interior region into an upper plenum communicating with the aperture means and a separate lower plenum, and means for supplying the combustible air and fuel mixture into the lower plenum, and the partitioning means is formed to include distribution means for communicating the combustible air and fuel mixture from the lower plenum to the upper plenum to achieve a uniform distribution of the combustible air and fuel mixture in the upper plenum for delivery to the open-space combustion chamber through the aperture means formed in the bottom section.

41. A radiant burner comprising a hollow housing including a lower shell and an upper shell coupled to the lower shell and formed to include a heat-discharging outlet, a unified block of insulation material mounted in the upper shell and formed to include an open-space combustion chamber having a top opening facing the heat-discharging outlet in the upper shell, the unified block of insulation material being formed to include aperture means for communicating a combustible air and fuel mixture from an interior region in the lower shell to the open-space combustion chamber, means for supplying a combustible air and fuel mixture into the interior region of the lower shell so that said mixture flows into the open-space combustion chamber through the aperture means formed in the unified block of insulation material, means for igniting the combustible air and fuel mixture extant in the open-space combustion chamber to produce a flame, and a porous radiant member arranged to cover the top opening of the open-space combustion chamber and configured to provide means for defining a flame retention region therein sot ha the flame is stabilized in and contained wholly within the open-space combustion chamber, the porous radiant member being trapped in place between the unified block of insulation material and the upper shell to retain the porous radiant member in its top-opening covering position and in contact with the flame produced in the open-space combustion chamber.

42. The radiant burner of claim 41, wherein comprising means for partitioning the interior region of the lower shell into an upper plenum communicating with the aperture means and a separate lower plenum communicating with the supply means.

43. The radiant burner of claim 42, wherein the partitioning means includes a perforated plate attached to the lower shell and arranged to underlie the unified block of insulation material.

44. The radiant burner of claim 42, wherein the partitioning means is formed to include perforation means for communicating the combustible air and fuel mixture from the lower plenum to the upper plenum to achieve a uniform distribution of the combustible air and fuel mixture in the upper plenum for delivery to the open-space combustion chamber through the aperture means formed in the unified block of insulation material.

45. A radiant burner comprising a hollow housing including a lower shell and an upper shell coupled to the lower shell and formed to include a heat-discharging outlet, a unified block of insulation material mounted in the upper shell and formed to include an open-space combustion chamber having a top opening facing the heat-discharging outlet in the upper shell, the unified block of insulation material being formed to include aperture means for communicating a combustible air and fuel mixture from an interior region in the lower shell to the open-space combustion chamber, means for supplying a combustible air and fuel mixture into the interior region of the lower shell so that said mixture flows into the open-space combustion chamber through the aperture means formed in the unified block of insulation material, means for igniting the combustible air and fuel mixture extant in the open-space combustion chamber to produce a flame, and a porous radiant member arranged to cover the top opening of the open-space combustion chamber and trapped in place between the unified block of insulation material and the upper shell to retain the porous radiant member in its top-opening covering position and in contact with the flame produced in the open-space combustion chamber, the radiant member being a rigid sheet of porous ceramic material.

46. The radiant burner of claim 45, wherein the radiant member further includes a silicon carbide coating on the rigid sheet of porous ceramic material.

47. The radiant burner of claim 45, wherein the rigid sheet of porous ceramic material has a thickness of less than 0.0625 inch (0.16 cm).

48. The radiant burner of claim 45, wherein the rigid sheet of porous ceramic material has a porosity of less than twelve percent open area.

49. The radiant burner of claim 41, wherein the unified block of insulation material includes a bottom section and a side section lying around a perimeter edge of the bottom section and cooperating with the bottom section to define the open-space combustion chamber underneath the radiant member and the communicating means includes a plurality of apertures formed in the bottom section and arranged to conduct the combustible air and fuel mixture from the air and fuel mixture into the open-space combustion chamber.

50. The radiant burner of claim 41, wherein the radiant member is porous and includes a heat-receiving surface communicating with the flame produced in the open-space combustion chamber and a heat-radiating surface emitting thermal radiation and transferring thermal energy by convection to heat a product positioned above the heat-discharging outlet in the upper shell and the radiant member and the unified block of insulating material includes border means for engaging the heat-receiving surface to support the radiant member so that the heat-receiving surface overlies the open-space combustion chamber and communicates with the flame produced therein.

51. The radiant burner of claim 50, wherein the upper shell includes clamp means for engaging the heat-radiating surface to clamp the heat-receiving surface to the border means so that the radiant member is fixed to the unified block of insulation material to cover the open-space combustion chamber.

* * * * *